United States Patent [19]

Fujiu et al.

[11] Patent Number: 4,741,178

[45] Date of Patent: May 3, 1988

[54] REFRIGERATING APPARATUS FOR A VENDING MACHINE

[75] Inventors: Minoru Fujiu, Onama; Kazumi Aoki, Gunma, both of Japan

[73] Assignee: Sanden Corporation, Isesaki, Japan

[21] Appl. No.: 39,723

[22] Filed: Apr. 20, 1987

[30] Foreign Application Priority Data

Apr. 19, 1986 [JP] Japan ..... 61-58257[U]

[51] Int. Cl.[4] ..... F25B 39/02

[52] U.S. Cl. ..... 62/525; 62/198

[58] Field of Search ..... 62/198, 526, 525

[56] References Cited

U.S. PATENT DOCUMENTS

| | | | |
|---|---|---|---|
| 2,515,825 | 7/1950 | Grant | 62/198 X |
| 2,667,757 | 2/1954 | Shoemaker | 62/526 X |
| 2,791,099 | 5/1957 | Jordan | 62/198 |

FOREIGN PATENT DOCUMENTS

| | | | |
|---|---|---|---|
| 0119024 | 12/1984 | European Pat. Off. | 62/525 |
| 0165220 | 12/1985 | European Pat. Off. | 62/198 |
| 2089067 | 2/1983 | United Kingdom | 62/525 |
| 2123180 | 1/1984 | United Kingdom | 62/525 |
| 2144838 | 1/1985 | United Kingdom | 62/525 |

*Primary Examiner*—William E. Wayner

*Attorney, Agent, or Firm*—Banner, Birch, McKie & Beckett

[57] ABSTRACT

There is disclosed a refrigerating apparatus suitable for use in a vending machine having a plurality of storage chambers. The refrigerating apparatus is provided with a plurality of evaporators which are connected in series and disposed individually in the storage chambers for refrigerating the same. A plurality of expansion devices are coupled in series with the evaporators, each of the expansion devices and evaporators being provided with a bypass having a valve means to direct the flow of the refrigerant into the evaporator through at least one of the expansion devices.

4 Claims, 3 Drawing Sheets

REFRIGERATING APPARATUS FOR A VENDING MACHINE

BACKGROUND OF THE INVENTION

This invention relates to a refrigerating apparatus and, more particularly, to a circuit suitable for use in the refrigerating apparatus for a vending machine which is provided with a plurality of merchandise storage chambers.

To meet the customer's demands, vending machines have heretofore been provided for storing and dispensing various types of merchandise which require storage under different temperature conditions. For example, one type of merchandise may require storage under refrigeration while another type of merchandise may require heating. Therefore, as shown in FIG. 1, a vending machine 1 has heretofore been provided that is divided internally into at least two storage chambers 1*a*, 1*b* for the different types of merchandise; and includes a refrigerating apparatus 2 and a heating device 3 for controlling the temperature in each of the chambers 1*a*, 1*b*.

The main refrigeration components of the refrigerating apparatus 2 are disposed in a mechanical chamber 4 formed below the storage chambers 1*a*, 1*b* and ventilated by a blower or fan 6. These components of the refrigerating apparatus, comprise a compressor 2*a*, a condenser 2*b* and a plurality of evaporators 2*c*, 2*d*. These refrigeration components are coupled in series to form a closed refrigerant circuit as shown in FIG. 2. Air is circulated in each of the chambers 1*a*, 1*b* by a blower or fan 5*a*, 5*b*.

The inlet side of the first evaporator 2*c* is coupled to a magnetic valve 2*e* and an expansion device, such as a capillary tube 2*f*. The inlet side of the second evaporator 2*d* is connected to the discharge end of the condenser 2*b* through a magnetic valve 2*g* and the capillary tube 2*f* and is also connected to the discharge side of the first evaporator 2*c*. Thus, the refrigerant can be directed by operation of the magnetic valves 2*e*, 2*g* through the first and second evaporators 2*c*, 2*d* for refrigerating both the chambers 1*a*, 1*b* or through only the second evaporator 2*d* for refrigerating only the chamber 1*b*.

At least one heating device 3 is disposed in the first chamber 1*a* for use in heating the chamber 1*a* instead of cooling the same by the flow of the refrigerant in the first evaporator 2*c*. Thus the storage chambers 1*a*, 1*b* can be maintained either hot or cold depending on the type of merchandise being stored.

In a system of this nature, the refrigerant flow can be set in one of two ways, that is, to flow into both of the evaporators 2*c*, 2*d* in series or into only one of them. Accordingly, these systems cannot be used in vending machines requiring independent control of the refrigeration in each of two or more storage chambers.

SUMMARY OF THE INVENTION

It is a primary object of this invention to provide a refrigerating apparatus for a vending machine provided with a plurality of storage chambers which are used to dispense various different types of merchandise.

It is another object of this invention to achieve the above object by means that are relatively simple in construction.

Refrigerating apparatus for vending machines provided with a plurality of storage chambers in accordance with this invention comprise the usual refrigeration components including a compressor, a condenser, a plurality of expansion devices and a plurality of evaporators which are disposed individually in the storage chambers. These components are coupled with one another in series to form a closed refrigerant circuit in which the refrigerant can be circulated selectively to each of the storage chambers for the cooling or heating requirements of the merchandise stored in the chamber. The expansion devices and the evaporators are coupled in series and each series of the expansion devices and evaporators is provided with a bypass including a valve means to direct the flow of the refrigerant into each of the evaporators through at least one of the expansion devices.

Further objects, features and other aspects of this invention will be understood from the following detailed description of the preferred embodiments of this invention referring to the attached drawings.

DETAILED DESCRIPTION OF THE PREFERRED EMBODIMENT

Figure 1:
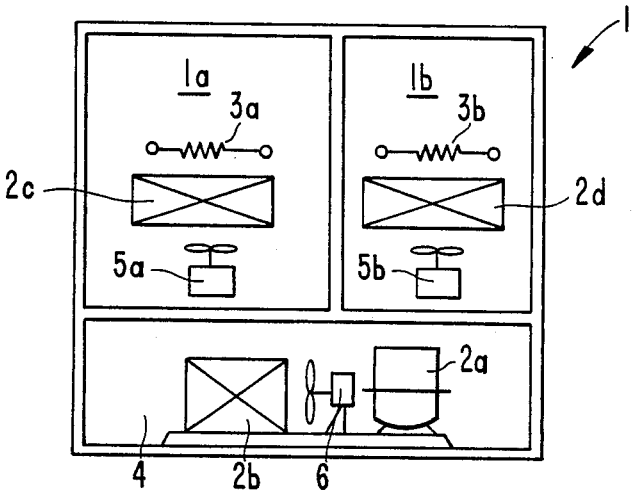
FIG. 1 is a diagramatic view of a vending machine that may have either conventional refrigerating apparatus or refrigerating apparatus in accordance with this invention.
Figure 2:
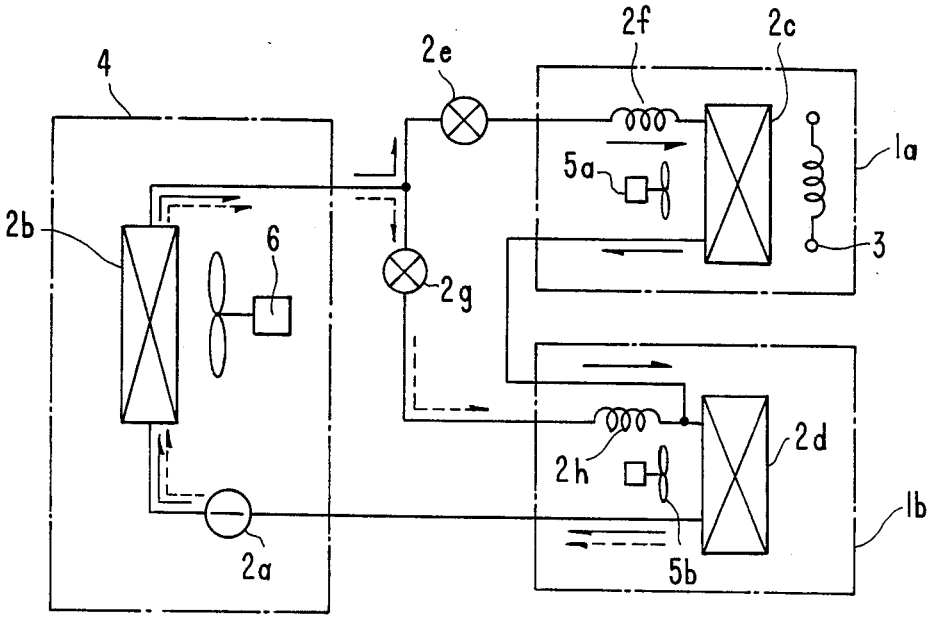
FIG. 2 PRIOR ART
FIG. 2 is a view showing a refrigerating circuit of a conventional refrigerating apparatus.
Figure 3:
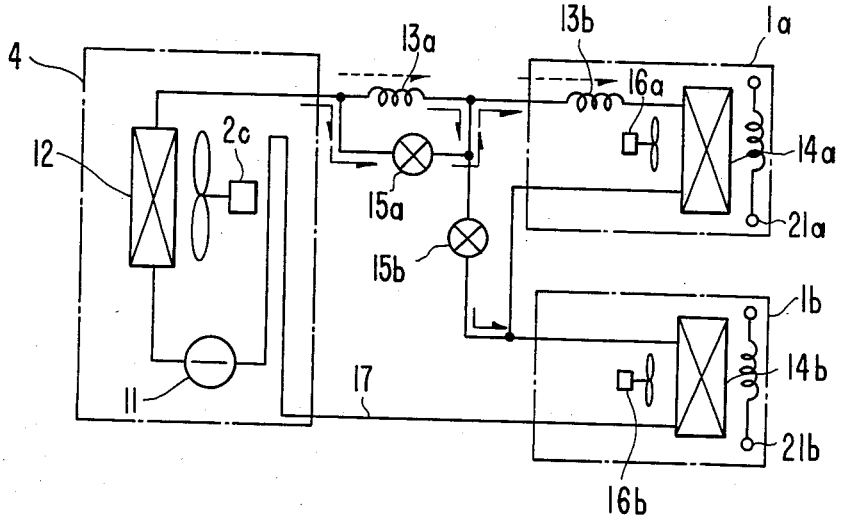
FIG. 3 is a view of a refrigerating circuit in accordance with one embodiment this invention.

Referring to FIG. 3, there is shown a refrigerating apparatus in accordance with this invention comprising a compressor 11, a condenser 12, a plurality of expansion devices such as the capillary tubes 13*a*, 13*b* and a plurality of evaporators 14*a*, 14*b*. These components are coupled with one another in series to form a closed refrigerating circuit. Compressor 11 and condenser 12 are disposed in a mechanical chamber 4 of the vending machine 1 which is ventilated by a blower or fan 20.

Evaporators 14*a*, 14*b* are disposed in the storage chambers 1*a*, 1*b* of the vending machine, respectively, to refrigerate those chambers. Heater elements 21*a*, 21*b* are also disposed in the storage chambers 1*a*, 1*b*, respectively, to heat the chambers when required by the stored merchandise. Air is circulated in each of the chambers 1*a*, 1*b* by a blower or fan 16*a*, 16*b*.

The intake side of the first evaporator 14*a*, which is disposed in the first storage chamber 1*a*, is connected with the discharge side of the condenser 12 by the two capillary tubes 13*a*, 13*b* which are connected in series. The first capillary tube 13*a* is connected to the output side of the condenser 12 and is also mounted in parallel with a first electromagnetic valve 15*a* in a bypass. The intake side of the second evaporator 14*b* is connected to the bypass through a second electromagnetic valve 15*b*.

In operation of the above described refrigerating apparatus, if both of the storage chambers 1*a*, 1*b* of the vending machine are to be refrigerated, the first valve 15*a* is opened and the second valve 15*b* is closed. Thus, the refrigerant flows into the first evaporator 14*a* through the second capillary tube 13*b* as indicated by the solid arrows in FIG. 3. Air is circulated through the first and second evaporators 14a, 14b to refrigerate the chambers 1a, 1b.

If the first storage chamber 1a is to be heated and the second chamber 1b is to be refrigerated, the first valve 15a is closed and the second valve 15b is opened. The refrigerant then is expanded in passing through the first capillary tube 13a and flows into the second evaporator 14b through the second valve 15b as shown by the dot and dash arrow in FIG. 3. In this case, while the intake side of the first evaporator 14a is connected with the first capillary tube 13a through the second capillary tube 13b, the flow resistance in the second capillary tube 13b is high enough relative to that of the line into the second evaporator to prevent any significant flow of refrigerant into the first evaporator 14a. The second storage chamber 1b is thus refrigerated and the first storage chamber can be heated by operation of the heating element 21a.

Conversely, if the first storage chamber 1a is to be refrigerated and the second storage chamber 1b is to be heated, both valves 15a, 15b are closed. The refrigerant then flows into the first evaporator 14a through the capillary tubes 13a, 13b as indicated by the dotted arrow in FIG. 3. In this case, the amount of the refrigerant flowing into the first evaporator 14a is reduced because the refrigerant must pass through both capillary tubes 13a, 13b and thus most of the refrigerant is expanded in the first evaporator 14a and only the gaseous refrigerant passed through the second evaporator 14b. Thus, the first storage chamber 1a is refrigerated due to operation of the refrigerating apparatus, and the second storage chamber 1b is heated due to operation of the heater element 21b. Refrigerant exhausted from the evaporator 14b is cooled by the blower 20 in the mechanical chamber 4 before passing into the compressor 11. Thus, the discharge line 17 from the second evaporator 14 is formed to pass near the blower 20.

As mentioned above the temperature in each of the storage chambers of the vending machine can be controlled by changing the connections of the electromagnetic valves and capillary tubes which are disposed between the discharge side of the condenser 12 and the intake side of the evaporators 14a, 14b. The temperature in each of the chambers 1a, 1b can be controlled by controlling the operation of the compressor 11 and or the heating elements 21a, 21b.

Figure 4:
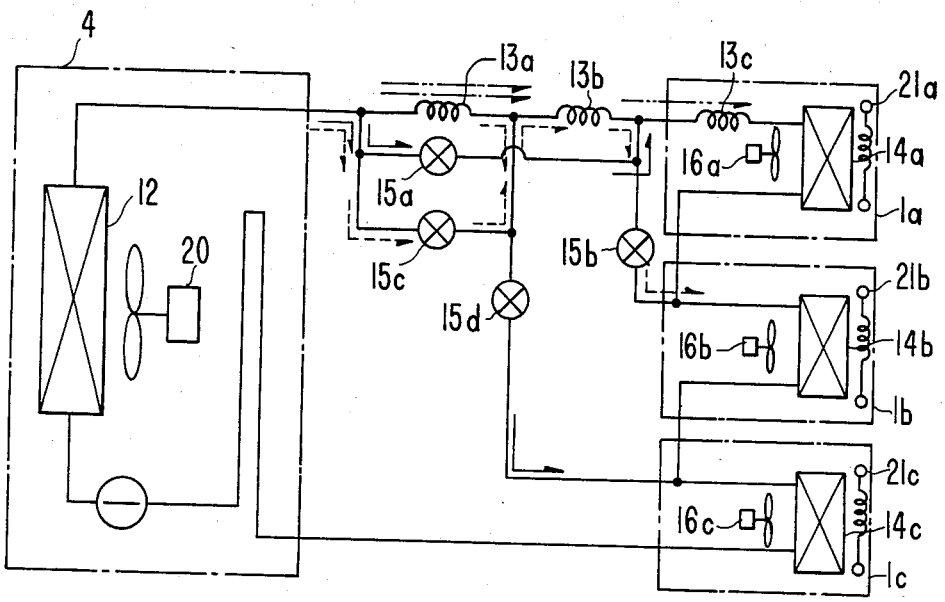
FIGS. 4 and 5 are views similar to FIG. 3, but showing modified refrigerating circuits in accordance with this invention.
Figure 5:
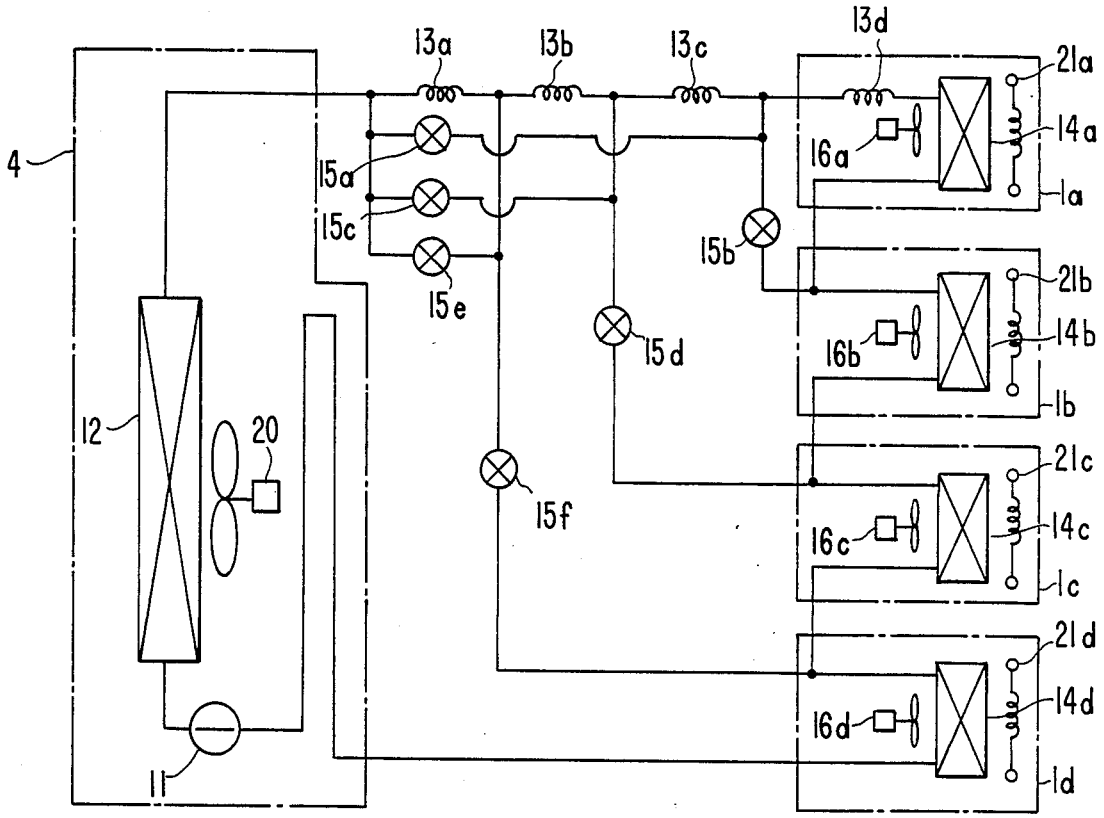

As shown in FIG. 3, the present invention is embodied in a circuit having two evaporators. The invention is also adapted for use in vending machines having three or more storage chambers, each of which is designed to be kept at a predetermined temperature. Referring to FIGS. 4 and 5, there is shown a refrigerating apparatus in accordance with this invention in which there are three and four evaporators respectively. A plurality of capillary tubes and evaporators, for example, three or four capillary tubes 13a, 13b, 13c and 13d, and three or four evaporators 14a, 14b, 14c and 14d, are connected in series. All of the serially connected capillary tubes, except for the capillary tube 13c (13d in FIG. 5) which is directly connected to the intake side of the first evaporator 14a, that is, the capillary tubes 13a, 13b (and 13c in FIG. 5), are adapted to be bypassed by a line in which there is disposed a first electromagnetic valve 15a. Also, the capillary tube 13a (and 13b in FIG. 5) is provided with a second bypass in which there is disposed a second electromagnetic valve 15c. This arrangement of bypasses including the electromagnetic valves, is repeated for each additional capillary tube and thus for each the evaporator as shown in FIG. 5.

On the other hand, the intake side of the second evaporator 14b is also connected with a first bypass through the electromagnetic valve 15b, and the intake side of the third evaporator 14c is connected with a second bypass through the electromagnetic valve 15d. This arrangement of connecting the intake side of each evaporator with one of the bypasses through an electromagnetic valve is also repeated for each additional evapoators as shown in FIG. 5.

In the refrigerating apparatus as disclosed, the flow of the refrigerant is controlled by opening and closing the respective electromagnetic valves, that is, the temperature in each of the storage chambers is controlled by operation of the respective electromagnetic valves and operation of the heater elements 21a, 21b, 21c and 21d.

Referring to FIG. 4, if all of the storage chambers 1a, 1b and 1c are to be refrigerated, only the first electromagnetic valve 15a is opened. The refrigerant then flows into the first evaporator 14a through the capillary tube 13c (the flow of the refrigerant is indicated by the solid arrows in FIG. 4). In each of the chambers 1a, 1b, and 1c air is circulated through the evaporator by the blowers 16a, 16b, 16c and 16d.

If the first storage chamber 1a is to be heated while the other storage chambers 1b, 1c are to be refrigerated, valves 15a, 15d are closed and valves 15b and 15c are opened (the flow of refrigerant is indicated by the dotted arrows in FIG. 4). The refrigerant then flows in series into the second and third evaporators 14b and 14c through the second capillary tube 13b.

If both the first and second storage chambers 1a, 1b are to be heated while only the third storage chamber 1c is to be refrigerated, only the valve 15d is opened (the flow of refrigerant is indicated by the dot and dash arrows in FIG. 4). Thus the refrigerant flows only into the third evaporator 14c through the first capillary tube 13a. On the other hand, if only the first storage chamber 1a is to be refrigerated and the remaining storage chambers are to be heated, all of the electromagnetic valves 15a, 15b, 15c and 15d are closed (the flow of the refrigerant is indicated by the double dot and dash arrows in FIG. 4). Thus, the refrigerant flows into the first evaporator 14a through the three capillary tubes 13a, 13b and 13c in series. In this case the amount of the refrigerant flowing into the first evaporator 14a is very small, and its heat-absorbing capacity is exhausted in the first evaporator so that only the gaseous refrigerant is passed through the second and third evaporators 14b, 14c. Accordingly, while the first storage chamber 1a is refrigerated, the remaining storage chambers 1b and 1c can be heated by the heating elements 21b and 21c.

If the first and second storage chambers 1a, 1b are to be refrigerated and only the third storage chamber 1c is to be heated, only the valve 15c is opened. The refrigerant then flows into the first evaporator 14a through the second and third capillary tubes 13b and 13c. In this case the amount of the refrigerant is enough to refrigerate both of the chambers 1a, 1b while the remaining storage chamber 1c can be heated by the heating element 21c.

This invention has been described in detail in connection with the preferred embodiments. The embodiments, however, are merely for example only and the present invention is not restricted thereto. It will be understood by those skilled in the art that other variations and modifications can be easily made wtihin the scope of this invention as defined in the appended claims.

We claim:

1. In a refrigerating apparatus for a vending machine provided with a plurality of storage chambers, said apparatus comprising refrigeration components including a compressor, a condenser, a plurality of evaporators adapted to be disposed one in each of said storage chambers and a plurality of expansion devices corresponding in number to the number of said evaporators, said refrigeration components being connected in series to form an enclosed refrigerating circuit adapted to refrigerate each of said storage chambers individually in accordance with the merchandise to be stored therein, the improvement comprising connecting said expansion devices in series with each other and with the intake of a first one of said evaporators, a bypass for each of said expansion devices, and valve means for selectively directing the refrigerant into each of said evaporators through at least one of said expansion devices.

2. The refrigerating apparatus in accordance with claim 1 wherein said expansion devices are capillary tubes.

3. The refrigerating apparatus in accordance with claim 1 wherein said valve means comprise electromagnetic valves.

4. In a refrigerating apparatus for a vending machine provided with a plurality of storage chambers, said apparatus comprising refrigeration components including a compressor, a condenser, a plurality of evaporators adapted to be disposed one in each of said storage chambers and a plurality of expansion devices corresponding in number to the number of said evaporators, said refrigeration components being connected in series to form an enclosed refrigerating circuit adapted to refrigerate eachof said storage chambers individually in accordance with the merchandise to be stored therein, the improvement comprising connecting the intake of a first evaporator with the discharge from said compressor through each of said expansion devices in series, a bypass for each of said expansion devices and valve means for selectively directing the refrigerant into each of said evaporators through at least one of said expansion devices, each of said bypasses being connected to the discharge from said compressor in parallel to one or more of said expansion devices and adapted to be connected individually through said valve means to the intake of a respective one of said evaporators and to the input of one of said expansion devices in the series of said expansion devices.

* * * * *